US011686472B2

(12) United States Patent
Suchorabski et al.

(10) Patent No.: US 11,686,472 B2
(45) Date of Patent: Jun. 27, 2023

(54) CONTROLLED SECONDARY AIR SUPPLY RANGE BURNER

(71) Applicant: GAS TECHNOLOGY INSTITUTE, Des Plaines, IL (US)

(72) Inventors: Daniel Suchorabski, Chicago Ridge, IL (US); Michael Frank Johnson, Elmhurst, IL (US); Shawn Scott, Mount Prospect, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 89 days.

(21) Appl. No.: 17/337,045

(22) Filed: Jun. 2, 2021

(65) Prior Publication Data

US 2021/0372612 A1 Dec. 2, 2021

Related U.S. Application Data

(60) Provisional application No. 63/033,357, filed on Jun. 2, 2020.

(51) Int. Cl.

| | |
|---|---|
| ***F23D 14/84*** | (2006.01) |
| ***F24C 3/08*** | (2006.01) |
| ***F23N 3/00*** | (2006.01) |
| ***F23L 9/06*** | (2006.01) |

(52) U.S. Cl.
CPC ..... *F23D 14/84* (2013.01); *F23L 9/06* (2013.01); *F23N 3/007* (2013.01); *F24C 3/085* (2013.01); *F23N 2237/16* (2020.01)

(58) Field of Classification Search
CPC .. F23C 3/085; F24N 3/007; F23L 9/06; F23D 14/84
USPC ..... 126/39 E, 39 R
See application file for complete search history.

(56) References Cited

U.S. PATENT DOCUMENTS 3,597,135 A * 8/1971 Kweller ..... F24C 3/085 431/286
2011/0265782 A1* 11/2011 Diggins ..... F23D 14/065 126/39 E

* cited by examiner

*Primary Examiner* — Vivek K Shirsat
(74) *Attorney, Agent, or Firm* — Pauley Erickson & Swanson

(57) ABSTRACT

A powered secondary air supply ranger burner and method thereof provide an efficient burner with improved heat transfer. An atmospheric range burner controls a burner flame by insulating the burner and supplying a secondary air to the burner. The secondary air concentrates a heating zone to a center of a cooking vessel to be heated by the burner flame. The secondary air also controls a size and a shape of the burner flame.

19 Claims, 8 Drawing Sheets

CONTROLLED SECONDARY AIR SUPPLY RANGE BURNER

CROSS REFERENCE TO RELATED APPLICATION(S)

This application claims the benefit of U.S. Provisional Application Ser. No. 63/033,357, filed on 2 Jun. 2020. The provisional application is hereby incorporated by reference herein in its entirety and is made a part hereof, including but not limited to those portions which specifically appear hereinafter.

BACKGROUND OF THE INVENTION

Field of the Invention

This invention generally relates to supplying secondary air to atmospheric burners to control heat transfer.

Discussion of Related Art

Prior art range top burners may include atmospheric burners. However, these burners concentrate flame heat along the sides of cooking vessels, resulting in loss of heat. The flame location is not properly controlled as the burner is open and exposed with insufficient insulation to adequately control the location and distribution of heat. Other current range top burners include power burners intended to improve emissions and efficiency. Other products to improve efficiency include modified cooking vessels that include various designs to promote efficiency with the use of a standard range top atmospheric burner.

SUMMARY OF THE INVENTION

This invention relates to an atmospheric range burner and a method of using the atmospheric range burner to control a burner flame. The burner is insulated and less "open" than conventional range burners. A secondary air is supplied to the burner to concentrate a heating zone of the burner flame and to control the size and shape of the burner flame. The heating zone is concentrated to a center of a cooking vessel that is heated by the burner flame. These improvements result in the atmospheric range burner attributing improved heat transfer, less heat loss to the environment, improved combustion efficiency and controlled flame location.

One embodiment of the invention includes a range top burner unit to provide heat to a cooking surface. The range top burner unit includes a burner that provides an open flame for cooking. The open flame provides a heating zone for the cooking surface. A gas line is included to provide fuel to the burner for combustion. A powered secondary air supply (PSAS) targets heat transfer from the heating zone to a center of the cooking surface. An insulation component is integrated under the burner. The heating zone includes a plurality of open flames. Each flame of the open flames protrudes in a vertical direction from the burner. The PSAS reduces NOx emissions from the burner unit to preferably 35-85 ppm.

The PSAS also includes a spreader element adapted to provide a flow of air to at least one flame of the plurality of open flames of the burner. In one embodiment the spreader element is made of brass. The PSAS provides air to a plurality of burner ports on an inner burner ring of the burner. The burner also includes an outer burner ring. The insulation component surrounds the outer burner ring. The insulation component includes a plurality of openings around the outer burner ring. The plurality of openings in the insulation component allow air to reach a plurality of air ports on a side of the outer burner ring. This air maintains a vertical shape of the open flames of the burner.

The invention also includes a burner unit for a range top including an air supply for a burner. The burner and the air supply provide at least one open flame for cooking. An insulation component is integrated with a ring of the burner. The insulation component includes a plurality of openings. A powered secondary air supply (PSAS) is provided for the burner. The PSAS provides additional air to the burner through the plurality of openings of the insulation component. In one embodiment the insulation component has two openings. In one embodiment the insulation component has three openings. The three openings are spaced equidistant from one another around the ring of the burner.

This invention also includes a method of operating a range burner unit to control a burner flame. The method includes controlling a firing rate of a burner with knobs on the burner unit, controlling primary burner aeration with a shutter on an inlet of the burner, supplying a secondary air to at least one burner flame, concentrating a heating zone to a center of a cooking vessel to be heated by the at least one burner flame, and controlling a size and a shape of the at least one burner flame with the secondary air.

Insulation is added to a ring of the burner for controlling the secondary air supply to the burner. The insulation prevents excessive air flow to the burner from underneath the burner unit. A needle valve controls an air flow rate of the secondary air supply. The air flow rate of the secondary air supply results in a vertical shape of the burner flame. The method also controls byproduct emissions from the burner unit, such as NOx and CO emissions.

Other objects and advantages will be apparent to those skilled in the art from the following detailed description taken in conjunction with the appended claims and drawings.

DETAILED DESCRIPTION

The present invention provides a method of supplying secondary air for atmospheric burners. An atmospheric range top burner where an open flame is located below a cooking vessel is improved to combat the shortcomings of other range top burners. While this invention applies to atmospheric burners, the invention may also apply to a variety of other heating applications with a similar heat transfer process.

Figure 1:
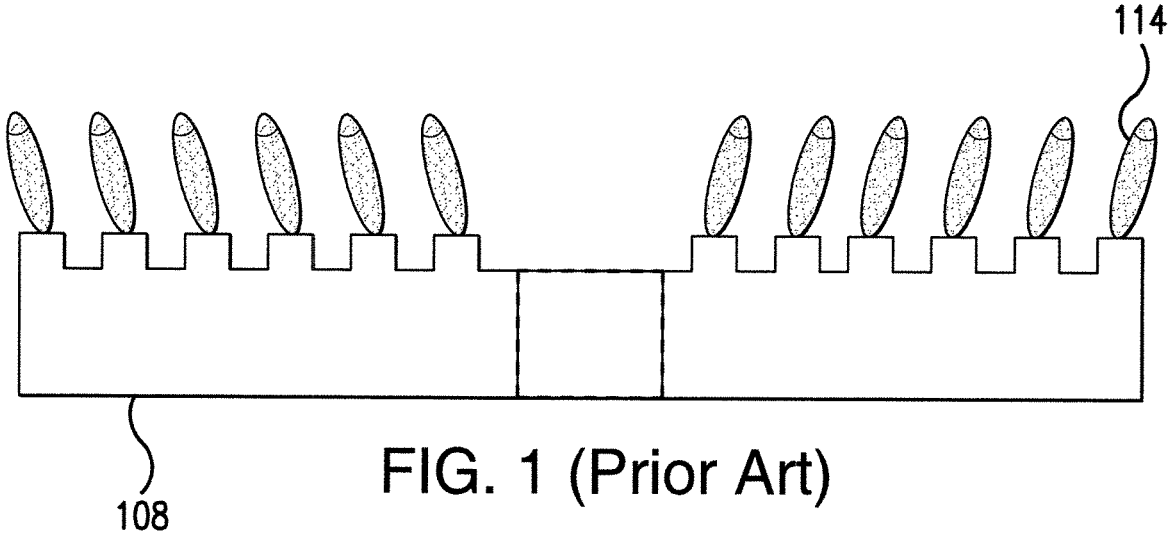
FIG. 1 (Prior Art)
FIG. 1 shows a cross-sectional view of a burner according to the prior art.

FIG. 1 shows a cross-section of a range top burner according to the prior art. A burner 108 includes a plurality of flames 114 for cooking. As shown, the flames 114 protrude from the burner 108 at an angle. As with most range top burners of the prior art, the flames protrude outward from the center of the burner, therefore running up the sides of a cooking vessel when the vessel is atop the burner. A range top burner according to the present invention provides an apparatus and method which causes flames on a burner to protrude vertically from the burner surface, thereby provided greater efficiency and accuracy in heating contents of a cooking vessel.

Figure 2:
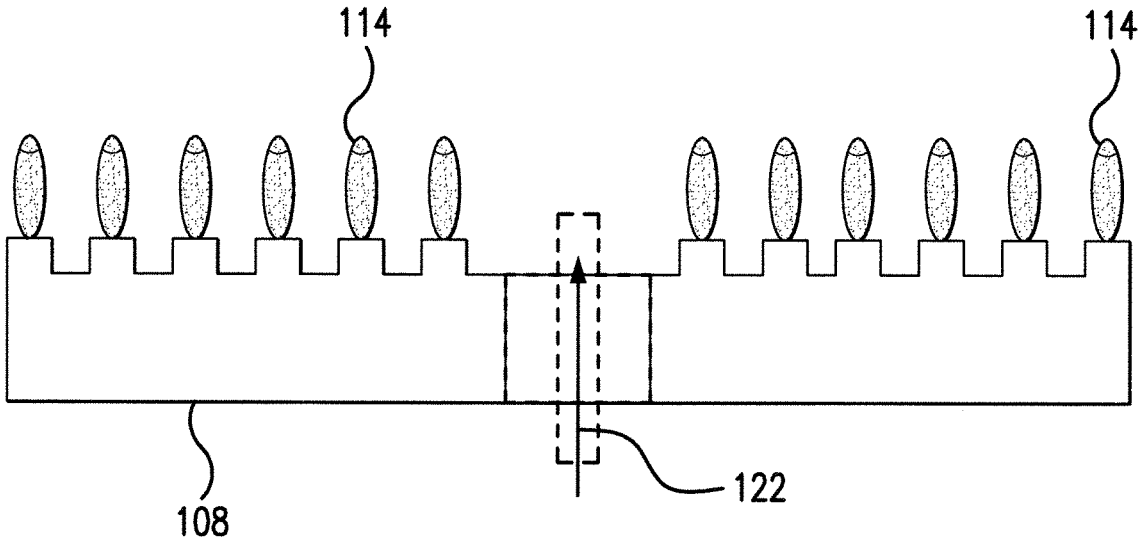
FIG. 2 shows a cross-sectional view of a burner according to one embodiment of the invention.

FIG. 2 shows a cross-sectional view of a range top burner 108 according to one embodiment of the invention. The burner includes a plurality of open flames 114 when the burner 108 is in use. A powered secondary air supply (PSAS) 122 is included protruding from a center of the burner 108. The PSAS 122 provides a controlled and targeted air supply which in turn controls the size and shape of the open flames 114. As shown, the addition of the PSAS 122 in the claimed invention, results in flames 114 that protrude in a vertical direction from a surface of the burner 108, as opposed to the flames of the prior art shown in FIG. 1. The PSAS 122 controls flame shape to improve heat transfer from the burner 108 to a cooking vessel. The PSAS can be supplied to at least one atmospheric burner by any reasonable means within the art, such as by a manifold or an individual blower. The manifold or blower can be added to an appliance or tapped off of another existing blower. The supply of secondary air to the at least one atmospheric burner concentrates a heating zone 116 to a center of a surface to be heated. The vertical flames 114 transfer heat to a bottom of a cooking vessel as opposed to the flames creeping up the sides of the vessel. It is to be understood that the surface to be heated or cooking vessel may be any number of surfaces whereby heating the surface is desired, such as a cooking vessel (frying pan, saucepan, pot), kettle, grill, or any other suitable surface. This is contrary to current burners where the heating zone 116 distributes heat along the sides of the surface, allowing heat to be lost. The PSAS can also help control certain emissions, for example, NOx. While air is naturally supplied to burners, in part, for maintaining burner flames, the PSAS of the claimed invention is controlled so that flames can in turn be controlled to a higher degree for improved burner operation.

Figure 3:
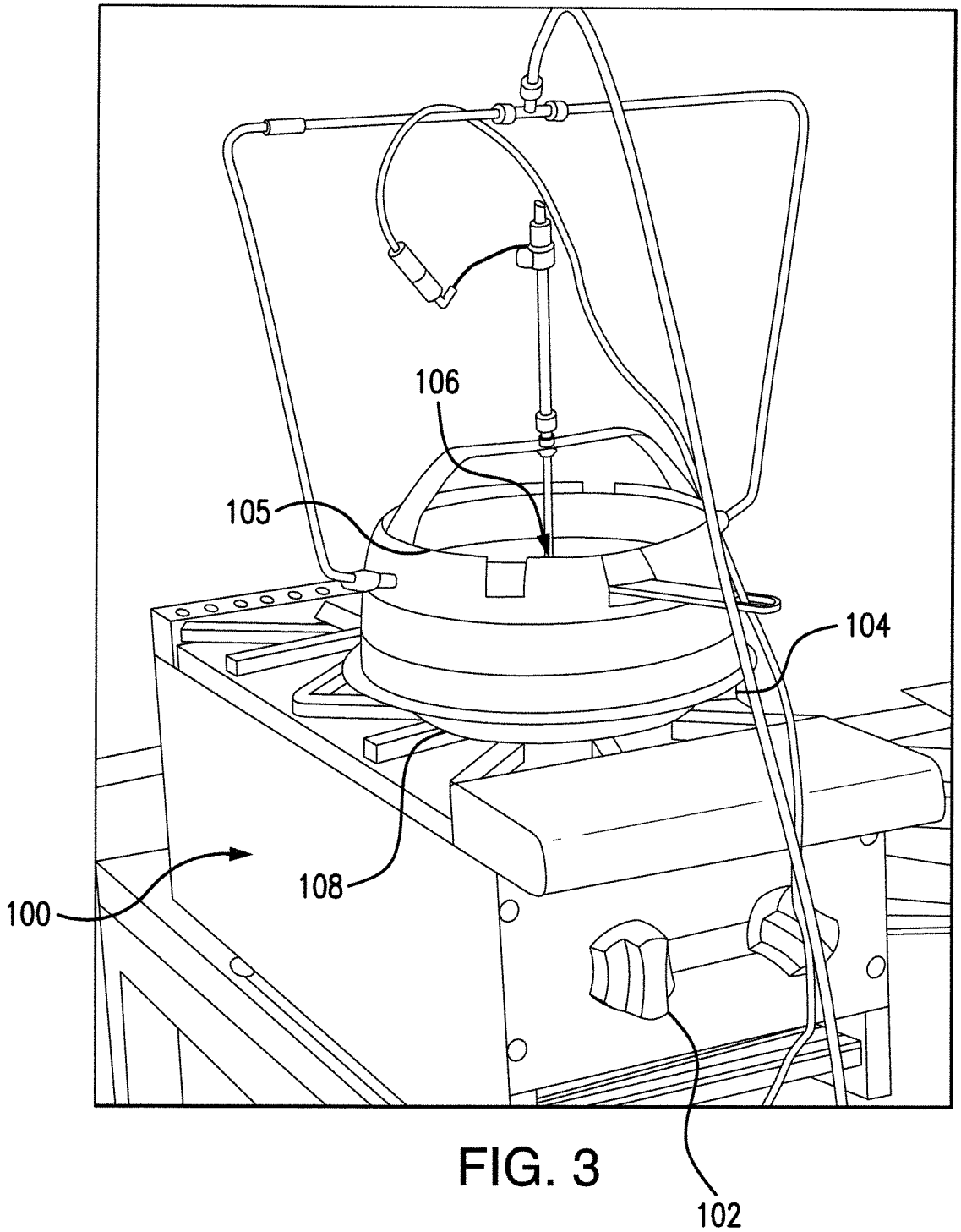
FIG. 3 shows a burner unit apparatus with a cooking surface according to one embodiment of the invention.
Figure 4:
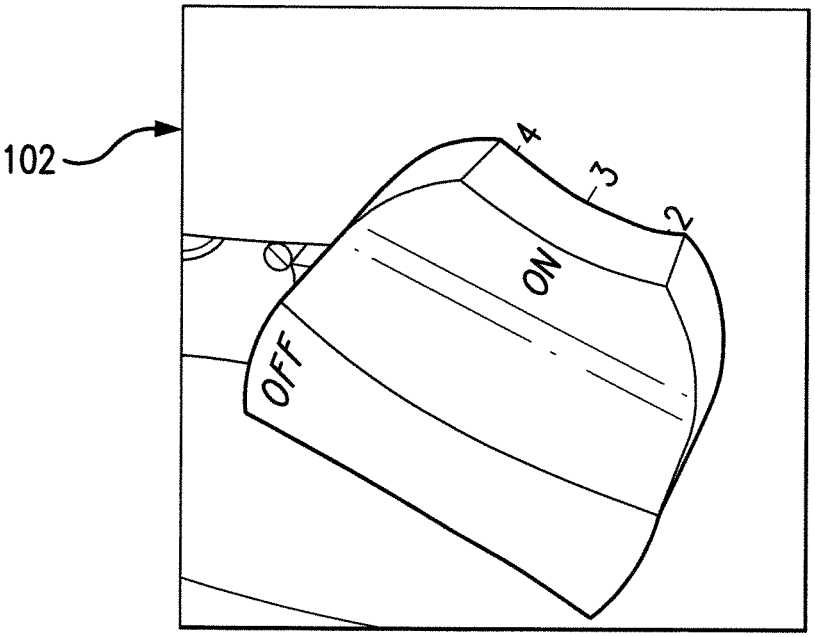
FIG. 4 shows a knob on a burner unit apparatus according to the embodiment shown in FIG. 3.

FIG. 3 shows a range top burner unit 100 where the burner 108 is heating a cooking surface 104, particularly a center 106 of the cooking surface 104. The operation of the burner unit 100 is controlled by a knob 102 (also shown in FIG. 4), as is common for most range top burner units. The knob 102 varies the firing rate of the burner. As shown, the cooking surface 104 of FIG. 3 includes a capture hood 105. The capture hood 105 is placed on top of the cooking surface 104 to test and capture certain emissions once the cooking surface 104 is heated by the burner unit 100.

In an example of the invention, the capture hood 105 was included to reduce or eliminate the dilution of flue gases coming off the burner unit, without interfering with normal operations of the burner. Flue gas samples were taken and water temperatures were monitored. The results are shown from various examples, discussed further below.

Figure 5:
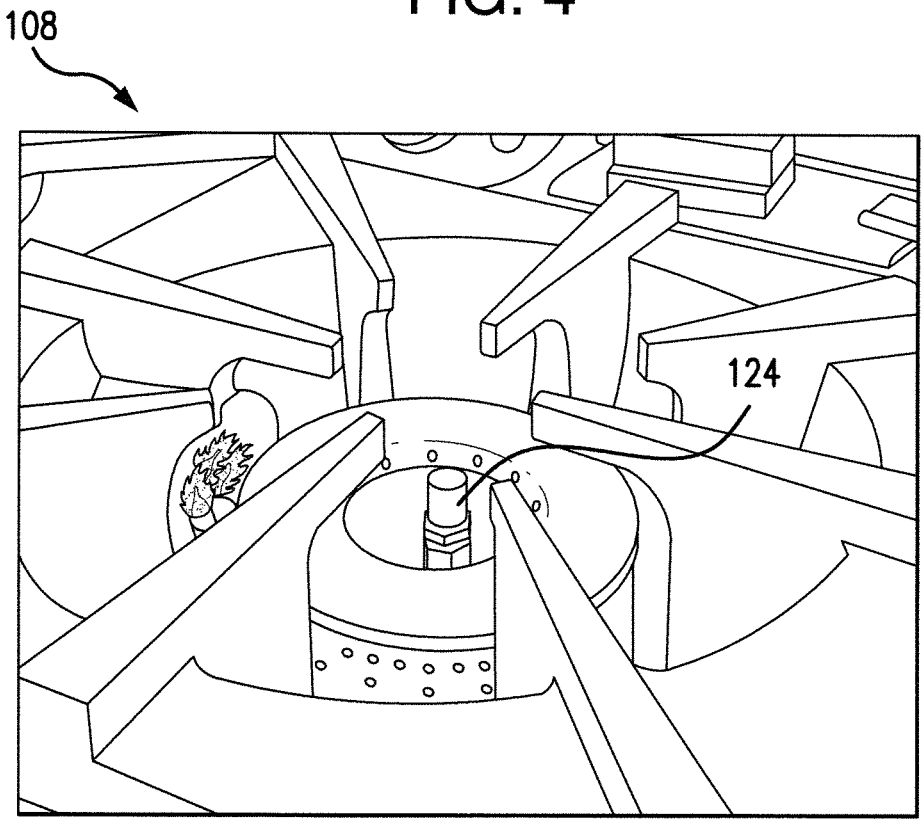
FIG. 5 shows a burner according to one embodiment of the invention.

FIG. 5 shows a close-up view of the burner 108. The burner 108 includes a spreader element 124. The spreader element 124 provides a flow of the PSAS to the flames from the center of the burner 108. The spreader element is preferably brass, although other suitable materials may be used as well. The spreader element 124 acts as a source to supply air near the burner 108. The overall design of the spreader element 124 can vary, particularly in reference to individual burner design, or the design of the overall appliance being used.

Figure 6:
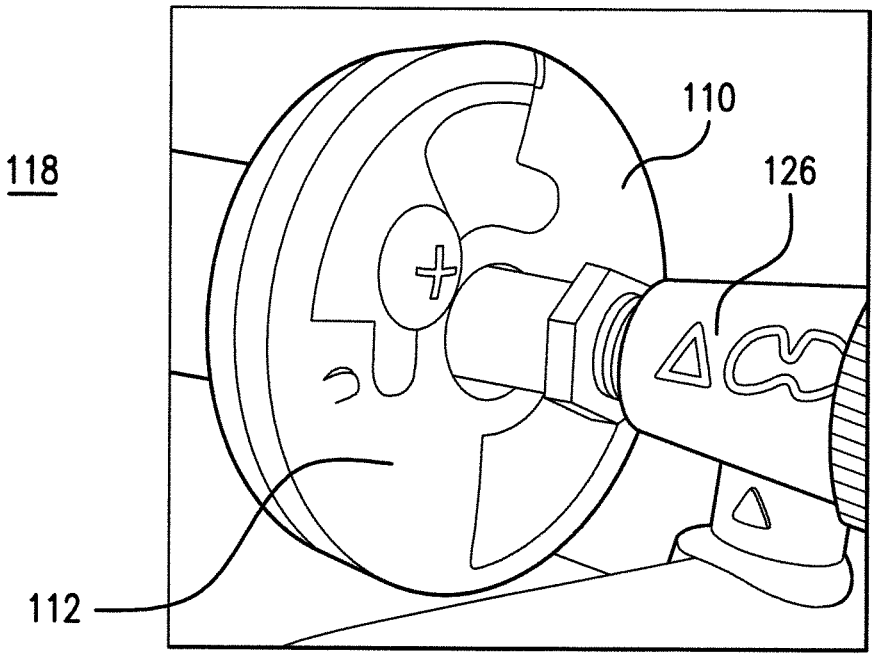
FIG. 6 shows a valve assembly of a burner according to one embodiment of the invention.

The spreader element 124 is located in the center of the burner 108, preferably the center of the inner burner ring, so that the spreader element 124 is in the center of the flames when the burner 108 is in use. The PSAS is released from the spreader element 124 at various quantities and speeds to accurately maintain an improved flame shape. The PSAS is provided to the spreader element 124 from a pathway. FIG. 6 shows a partial view of the pathway for the PSAS to reach the burner from a gas line 118 (not shown). The pathway includes an inlet 110 to the burner. The inlet 110 is attached to a shutter 112 on one end. The inlet 110 is attached to a needle valve 126 on another end. The needle valve 126 controls the PSAS coming out of the spreader element. The shutter 112 on the inlet 110 of the burner can vary primary burner aeration. The needle valve 126 can control an air flow rate from the PSAS. The controlled air flow rate of the PSAS is therefore controlled coming out of the spreader element.

Figure 7:
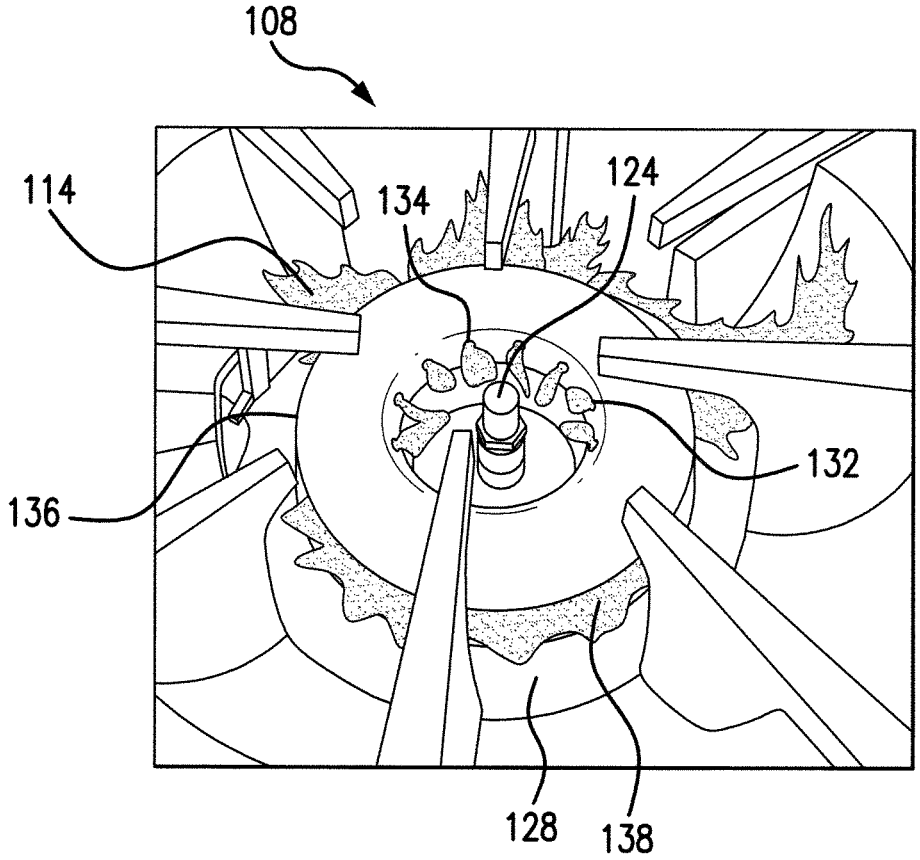
FIG. 7 shows a burner according to one embodiment of the invention.

FIG. 7 shows the burner 108 ignited with open flames 114. The burner 108 includes an inner burner ring 134 and an outer burner ring 136. Flames 114 protrude from burner ports 132 on the inner burner ring 134, and from air ports 138 on the outer burner ring 136. The burner 108 also includes an insulation component 128. The insulation component 128 surrounds the spreader element 124 insider a circumference of the inner burner ring 134. The insulation component 128 also surrounds the outer burner ring 136. The insulation component 128 is added under the burner 108 to prevent excess air flow to the burner from underneath the unit 100. As natural air may flow to the burner, in addition to the PSAS, this insulation component 128 allows for an additional level of control of the natural air. The PSAS can then optimally control the flame shape without the interference from natural air. The insulation component 128 can be added using any standard insulation compatible with ranges such as fiberglass insulation, Alkaline Earth Silicate (AES) fiber insulation, and ceramic fiber insulation, among others.

In one embodiment of the present invention, no additional space is needed around the burner to accommodate for natural secondary air. This allows the burner to be less "open" with more insulation from the insulation component to aid in concentrating the heat on the intended cooking surface. Rather than having excess heat lost into the environment, the heat is applied more centrally and directly to the cooking surface. The addition of the controlled PSAS results in less heat loss to the environment since the heat is able to be more concentrated on the cooking surface.

Figure 8:
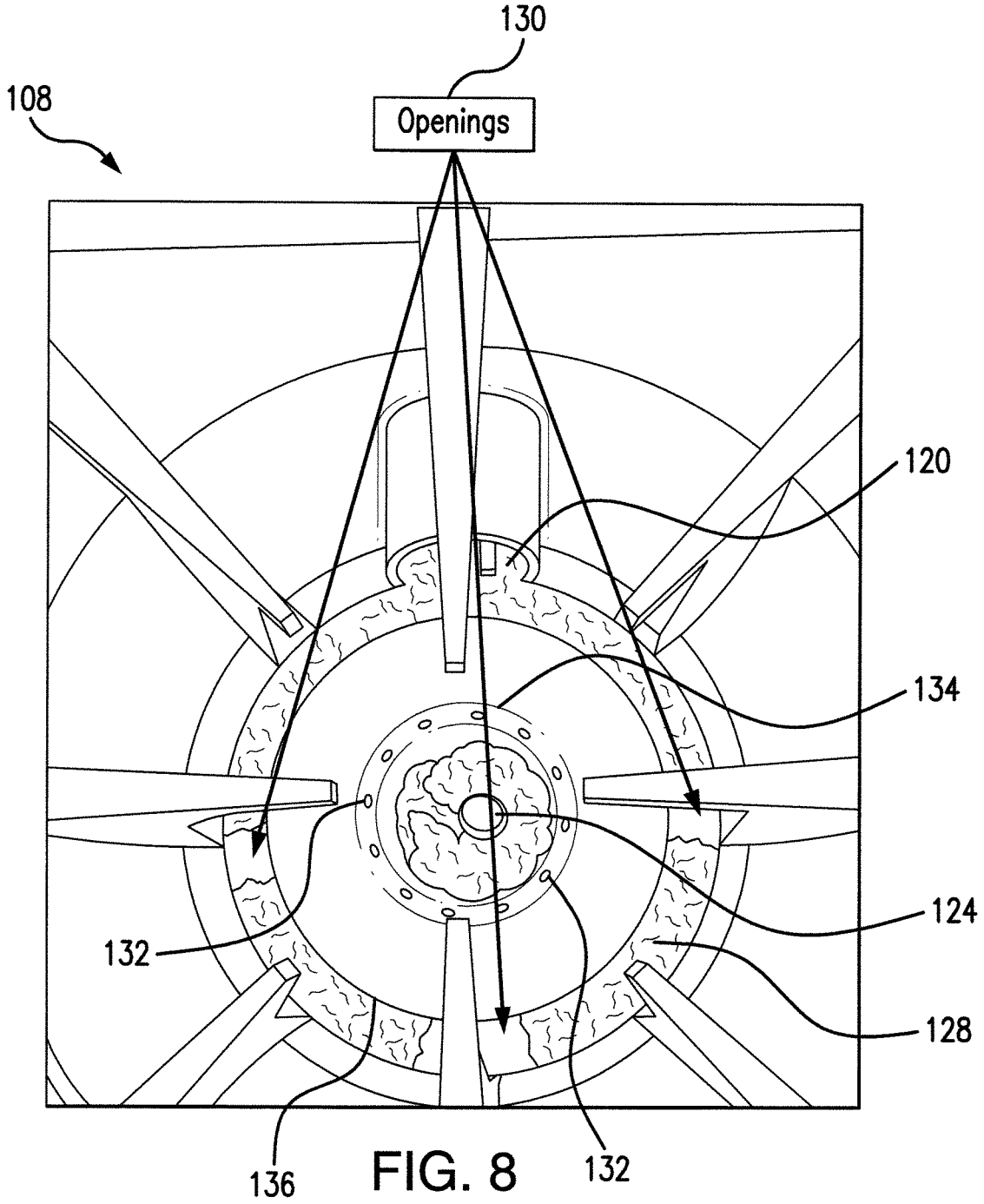
FIG. 8 shows a top view of a burner according to one embodiment of the invention.

FIG. 8 shows an embodiment of the present invention where the insulation component 128 of the burner 108 includes a plurality of openings 130. An air supply 120 is directed to the burner 108, as with most top range burners. The openings 130 in the insulation component 128 are spaced equidistant around the outer burner ring 136, from the air supply 120. As shown, the insulation component 128 has three openings 130. In one embodiment of the invention, the insulation component may have two openings. In one embodiment of the invention, the insulation component may have more than three openings. In one embodiment of the invention the spacing of the insulation component openings may vary. The addition of openings 130 in the insulation component 128, specifically on the outer ring 136, can provide an additional pathway for the PSAS to reach the outer ring of the burner. As the spreader element 124 is inside the inner burner ring 134, PSAS is more easily supplied to the burner ports 132 of the inner burner ring 134, in comparison to the burner ports 138 of the outer burner ring 136. The openings 130 can allow some PSAS to reach the burner at the outer ring.

EXAMPLES

As a goal of the claimed invention is to improve certain emissions associated with range burners, in addition to controlling the size and shape of burner flames, various examples were conducted in modifying the PSAS supply and the insulation of the burner. These examples illustrate or simulate various aspects involved in the practice of the invention. It is to be understood that all changes that come within the spirit of the invention are desired to be protected and thus the invention is not to be construed as limited by these examples. These examples specifically addressed NOx and CO emissions that were monitored and calculated (using a capture hood 105 such as shown in FIG. 3) by modifying characteristics of the insulation component and the PSAS.

Figure 9:
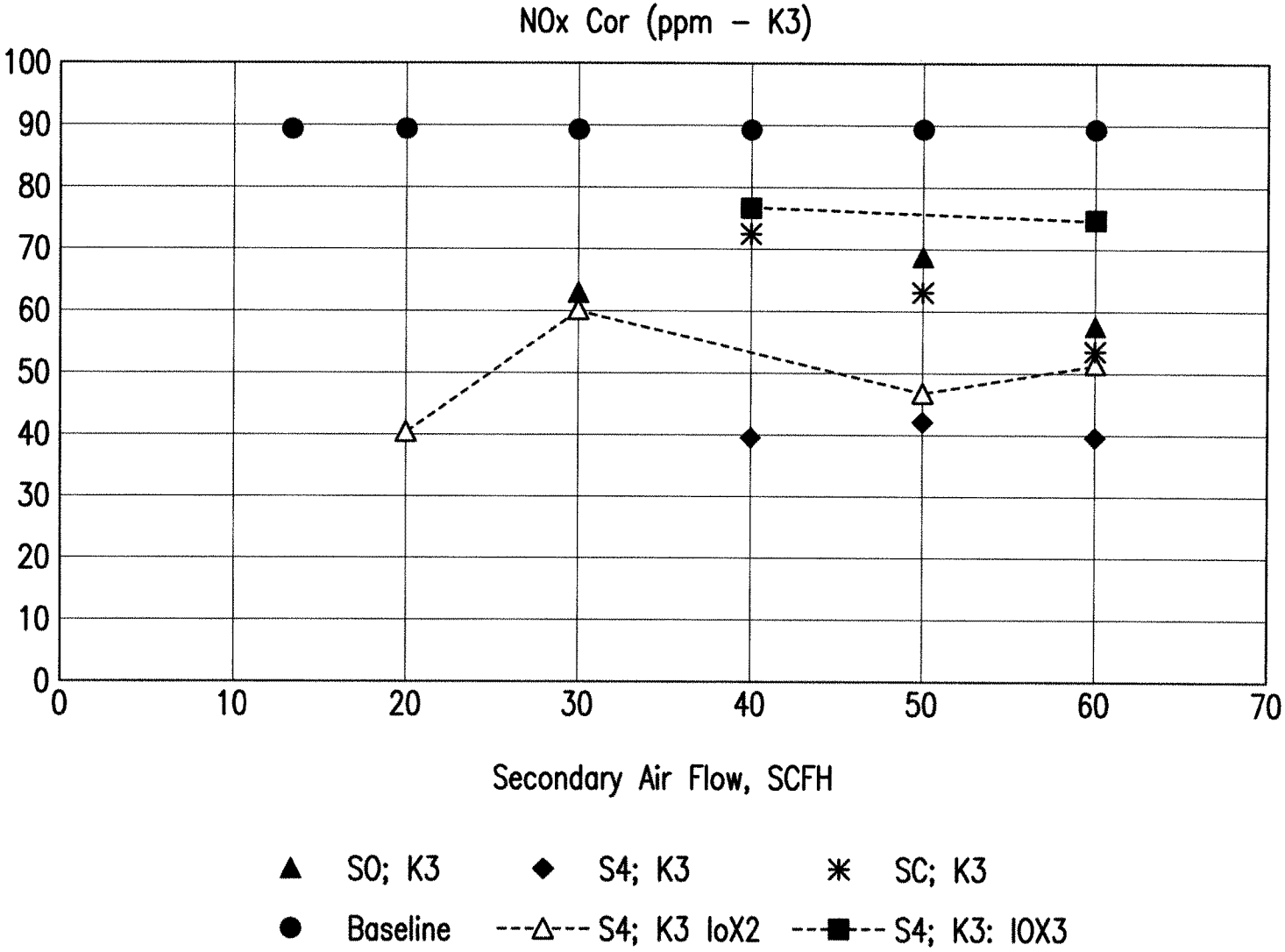
FIG. 9 shows a graph of NOx emissions according to one embodiment of the invention.
Figure 10:
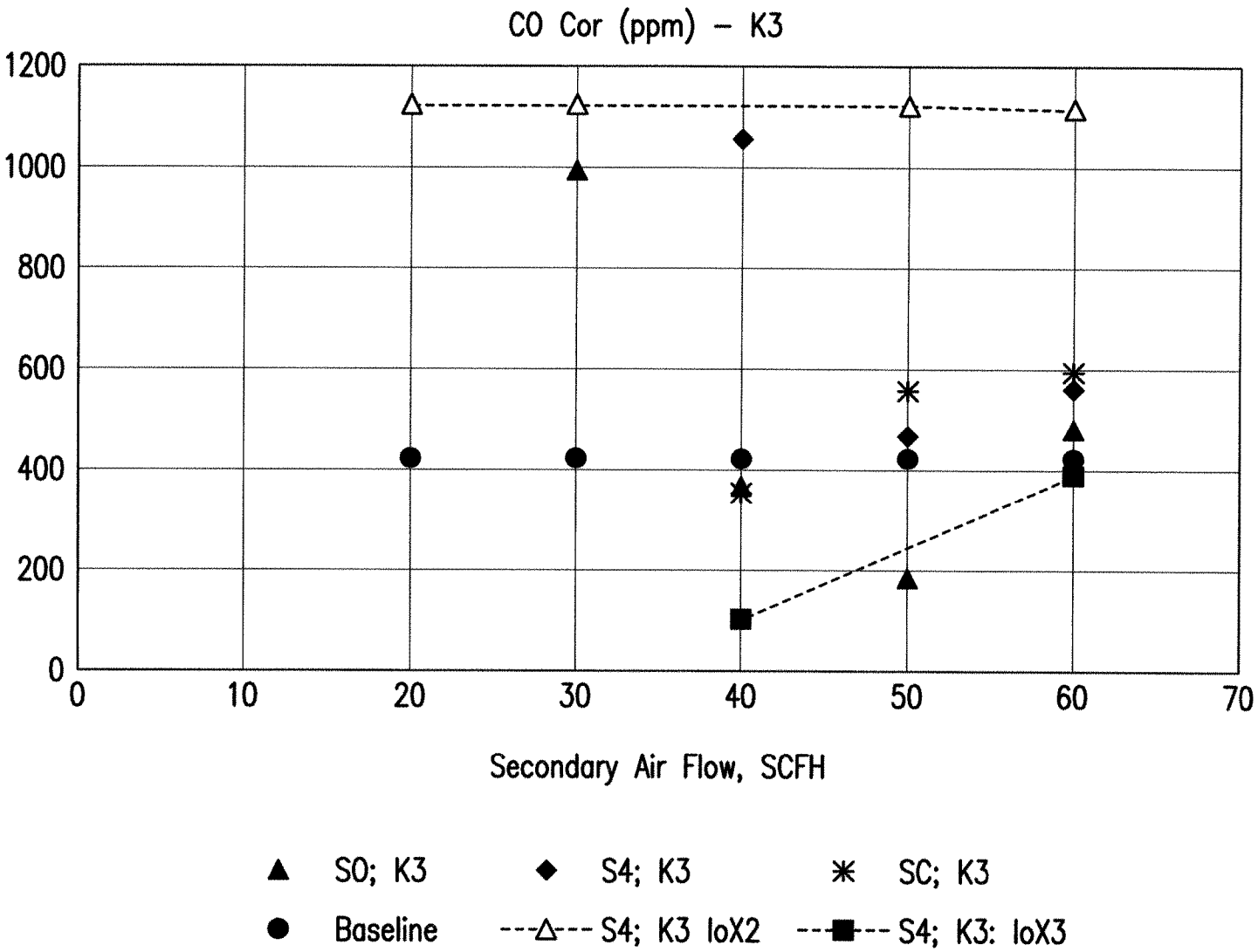
FIG. 10 shows a graph of CO emissions according to one embodiment of the invention.

FIG. 9 shows NOx emissions calculated with a burner according to the present invention. Emissions were calculated with several data sets including instances where secondary air was fully blocked from the burner, and where openings (such as those shown in FIG. 8) were added to the insulation—both two openings, and three openings. The obtained data, used to create FIGS. 9 and 10, is shown further in Table 1, below.

TABLE 1

Range Burner Data

| Test Case | Nox (ppm) | Nox Cor (ppm) | CO (ppm) | CO Cor (ppm) | CO2 (%) | O2 (%) | Firing Rate | Secondary Air |
|---|---|---|---|---|---|---|---|---|
| Baseline | 62.73 | 89.40 | 295.07 | 421.38 | 8.57 | 6.25 | 29482 | 60 |
| Baseline | 62.73 | 89.40 | 295.07 | 421.38 | 8.57 | 6.25 | 29481.77 | 50 |
| Baseline | 62.73 | 89.40 | 295.07 | 421.38 | 8.57 | 6.25 | 29481 77 | 40 |
| Baseline | 62.73 | 89.40 | 295.07 | 421.38 | 8.57 | 6.25 | 29481.77 | 30 |
| Baseline | 62.73 | 89.40 | 295.07 | 421.38 | 8.57 | 6.25 | 29481.77 | 20 |
| SO; K3; 60SCFH | 21.43 | 57.52 | 179.71 | 480.05 | 4.35 | 13.17 | 25400.90 | 60 |
| SO; K3; 50SCFH | 28.50452 | 68.78354 | 75.25619 | 183.68065 | 4.856844 | 12.30535 | 24920.998 | 50 |
| SO; K3; 40SCFH | 35.04185 | 72.49626 | 177.3606 | 365.62996 | 5.685057 | 10.84272 | 24968 | 40 |
| SO; K3; 30SCFH | 31.75521 | 62.92595 | 533.3701 | 992.44608 | 5.910665 | 10.42735 | 24680.292 | 30 |
| SO; K3; 20SCFH | | | | | | | | |
| S4; K3; 60SCFH | 13.25479 | 39.41558 | 190.4536 | 560.66411 | 3.991675 | 13.87194 | 26689.005 | 60 |
| S4; K3; 50SCFH | 16.17624 | 42.122 | 181.0676 | 466.68767 | 4.519693 | 12.92057 | 25768.146 | 50 |
| S4; K3; 40SCFH | 16.4165 | 39.52922 | 577.2428 | 1057.1838 | 5.01844 | 11.9802 | 25456.334 | 40 |
| S4; K3; 30SCFH | | | | | | | | |
| S4; K3; 20SCFH | | | | | | | | |
| SC; K3; 60SCPH | 17.87775 | 53.4422 | 198.1668 | 592.37303 | 4.006713 | 13.99019 | 24561.627 | 60 |
| SC; K3; 50SCFH | 25.24161 | 63.02021 | 222.8336 | 556.16761 | 4.773908 | 12.5883 | 24486.326 | 50 |
| SC: K3; 40SCFH | 29.48165 | 72.42424 | 144.6033 | 353.71786 | 4.857965 | 12.44477 | 24106.218 | 40 |
| SC; K3; 30SCFH | | | | | | | | |
| SC; K3; 20SCFH | | | | | | | | |
| S4; K3; IoX2; 60scfh | 18.56 | 51.28 | 433.65 | 1116.30 | 4.32 | 13.39 | 27476.22 | 60 |
| S4; K3; IoX2; 50scfh | 18.90 | 46.79 | 818.08 | 1125.00 | 4.74 | 12.49 | 26726.39 | 40 |
| S4; K3; IoX2; 30scfh | 32.69 | 60.21 | 1125.00 | 1125.00 | 6.18 | 9.59 | 19147.43 | 30 |
| S4; K3; IoX2; 10scfh | 30.31 | 40.31 | 1125.00 | 1125.00 | 8.49 | 5.17 | 27184.90 | 20 |
| S4; K3; IoX3; 60scfh | 22.20 | 74.85 | 115.53 | 388.05 | 3.62 | 14.77 | 23975.92 | 60 |
| S4; K3; IoX3; 40scfh | 30.74 | 76.77 | 40.91 | 101.38 | 4.80 | 12.60 | 24715.69 | 40 |

In Table 1, K3 represents the firing rate setting of the burner tested. SX represents the settings of the shutter on the inlet of the burner. The shutter settings included 0, 1, 2, 3, 4 and C (closed). The PSAS, or secondary air, was given to the burner in units of SCFH (standard cubic feet per hour). IoXx represents the number of openings that were placed in the insulation component. These examples were tested with secondary air being completely blocked off by insulation (the baseline), with two openings in the insulation component (IoX2), and with three openings in the insulation component (IoX3). The examples were used when heating a gallon of water with the burner from 0° to 190° F.

The baseline values from Table 1 are shown in FIG. 9. Even at the baseline, the present invention showed improved NOx emissions, reducing NOx emissions from 120 ppm as with prior systems, to 90 ppm for the present invention. Additional reduction in NOx emissions was observed by changing the flowrate for the PSAS and primary sir shutter for the burner. The data from Table 1, and shown in FIG. 9, also shows that NOx emissions were reduced even further when two openings were added to the insulation (see S4; K3; IoX2 values), and when three openings were added (see S4; K3; IoX3 values). With two openings in the insulation, NOx emissions were reduced to approximately 30-70 ppm, preferably 40-60 ppm. With three openings in the insulation, NOx emissions were reduced to approximately 60-90 ppm, preferably 70-80 ppm.

Data from the examples was also used to improve CO emissions within the acceptable range of ANSI range burner requirements, which requires CO emissions of less than 800 ppm, corrected to 0% $O_2$. In particular, improvement was observed at data point SO K3 50 SCFH for the air shutter in the 0 position and a PSAS flow rate of 50 SCFH. This results in NOx emission of 69 ppm, and CO emissions at 180 ppm (both corrected to 0% $O_2$).

FIG. 10 shows CO emissions calculated with a burner according to the present invention, also using the data from Table 1. CO emissions improved where the insulation component included three openings (see S4; K3; IoX3 values). With three openings in the insulation, CO emissions were reduced to approximately under 500 ppm, preferably 100-400 ppm. The best results were obtained for IoX3 at a shutter of S4 and PSAS flow rate of 40 SCFH for a NOx emission of 77 ppm and a CO emission of 101 ppm, both corrected to 0% $O_2$.

Figure 11:
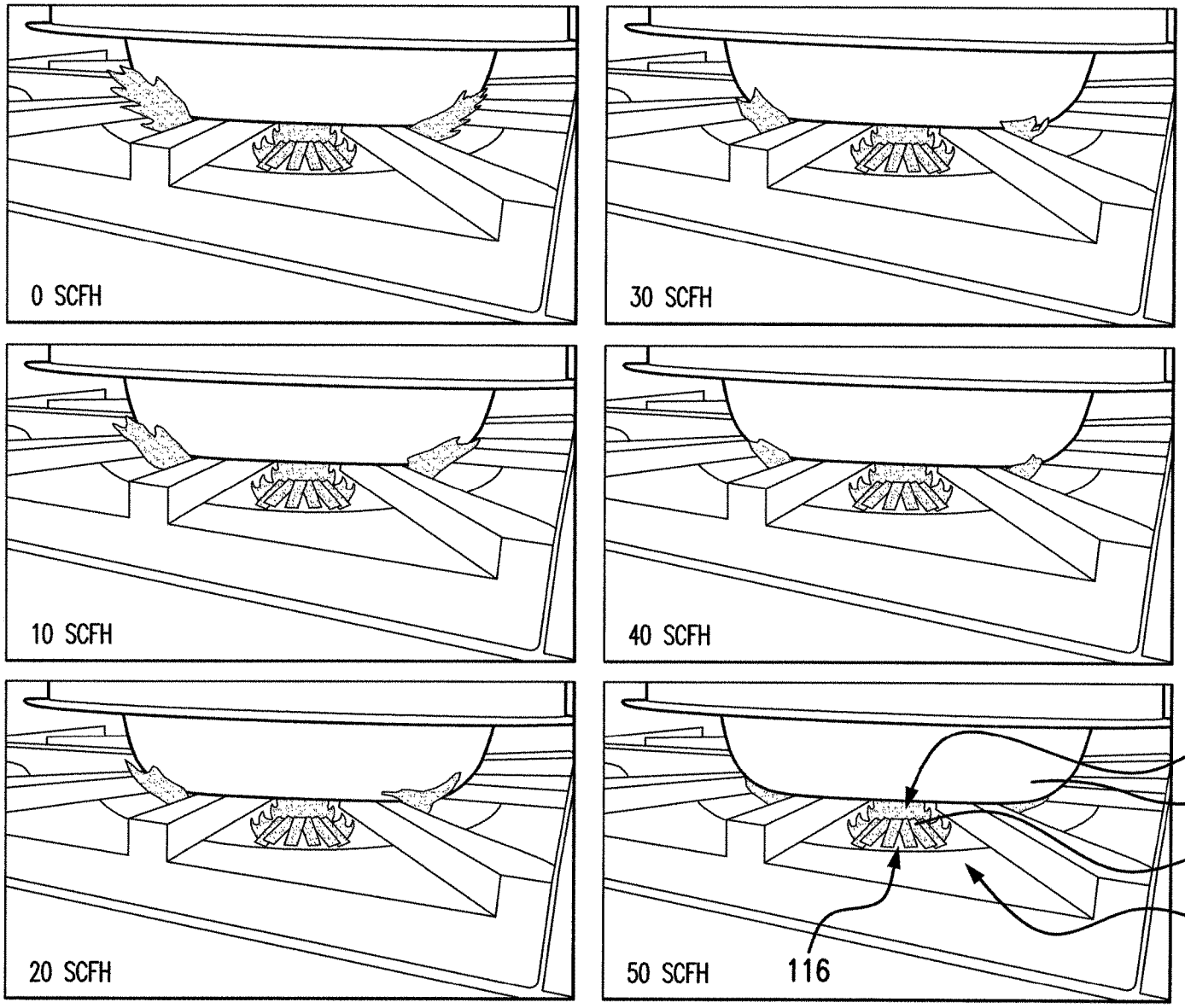
FIG. 11 shows side views of a series of burners with a cooking surface with increasing flow from a powered secondary air supply according to one embodiment of the invention.

FIG. 11 shows additional examples of the present invention for changing the flame shape of the burner with the PSAS. A series of fired burners 108 included cooking surfaces 104. The PSAS was delivered to the center 106 of the cooking surfaces 104 at varying quantities based on standard cubic feet per hour (SCFH). The flame shape changed as PSAS was provided to the burner. At 0 PSAS in SCFH, the flame shape included long blue fingers extended to the sides of the cooking surface throughout the heating zone 116. As the PSAS increased, up to preferably 50 SCFH, the flames were contained under the pot in the heating zone 116. The results shown in FIG. 11, combined with those shown in FIGS. 9-10, concluded that the present invention could control flame shape of a burner while also improving NOx and CO emissions.

In terms of cooking efficiency, range burners are generally less than about 40% efficient. Atmospheric range burners rely heavily on secondary air to complete combustion. When a pot or pan, or any other cooking vessel, is over a burner on conventional range burners, secondary air is limited and therefore a flame from the burner begins to seek additional air elsewhere. This may cause the flame to lengthen up sides of the cooking vessel which results is less efficient heat transfer from the burner to the cooking vessel. With the present invention, the flame of the burner shortens, allowing the flame and heat concentration to remain closer to a center of the surface to be heated. This therefore may improve efficiency and cooking performance of the subject burner by forming a more uniform heat transfer from the burner to the surface to be heated.

In addition to the above, the present invention may also be less costly than conventional burners. The PSAS range burner may be less expensive than pre-mix powered burners. In one embodiment, the PSAS range burner may be retrofitted onto an existing range. In another embodiment, the PSAS range burner may be part of an entirely new range system.

While in the foregoing detailed description the subject development has been described in relation to certain preferred embodiments thereof, and many details have been set forth for purposes of illustration, it will be apparent to those skilled in the art that the subject development is susceptible to additional embodiments and that certain of the details described herein can be varied considerably without departing from the basic principles of the invention.

What is claimed is:

1. A range top burner unit to provide heat to a cooking surface, the range top burner unit comprising:

a burner configured to provide an open flame for cooking, wherein the open flame provides a heating zone for the cooking surface;

a gas line configured to provide fuel to the burner for combustion;

a powered secondary air supply (PSAS) configured to target heat transfer from the heating zone to a center of the cooking surface, wherein the PSAS is configured to lower NOx emissions from the burner unit to preferably 35-85 ppm; and an insulation component integrated under the burner.

2. The burner unit of claim 1 wherein the heating zone comprises a plurality of open flames and wherein each flame of the open flames protrudes in a vertical direction from the burner.

3. The burner unit of claim 1 wherein the PSAS comprises a spreader element adapted to provide a flow of air to at least one flame of the plurality of open flames of the burner.

4. The burner unit of claim 3 wherein the spreader element is comprised of brass.

5. The burner unit of claim 1 wherein the PSAS is configured to provide air to a plurality of burner ports on an inner burner ring.

6. The burner unit of claim 1 wherein the burner comprises an outer burner ring, wherein the insulation component surrounds the outer burner ring.

7. The burner unit of claim 6 wherein the insulation component comprises a plurality of openings around the outer burner ring.

8. The burner unit of claim 7 wherein the plurality of openings are configured to allow air to reach a plurality of air ports on a side of the outer burner ring, wherein the air is configured to maintain a vertical shape of the open flames of the burner.

9. A burner unit for a range top, the burner unit comprising:

an air supply for a burner, wherein the burner and the air supply provide at least one open flame for cooking;

an insulation component integrated with a ring of the burner, the insulation component comprising a plurality of openings; and a powered secondary air supply (PSAS) for the burner, wherein the PSAS provides additional air to the burner through the plurality of openings of the insulation component, and further wherein the PSAS is configured to lower NOx emissions from the burner unit to preferably 35-85 ppm.

10. The burner unit of claim 9 wherein the insulation component comprises two openings.

11. The burner unit of claim 9 wherein the insulation component comprises three openings.

12. The burner unit of claim 11 wherein the three openings are spaced equidistance from one another around the ring of the burner.

13. The burner unit of claim 9 wherein the at least one open flame is vertical.

14. A method of operating a range burner unit to control a burner flame comprising:

controlling a firing rate of a burner with knobs on the burner unit;

controlling primary burner aeration with a shutter on an inlet of the burner;

supplying a secondary air to at least one burner flame;

concentrating a heating zone to a center of a cooking vessel to be heated by the at least one burner flame;

controlling byproduct emissions from the burner unit, wherein the byproduct emissions comprise NOx and CO; and controlling a size and a shape of the at least one burner flame with the secondary air.

15. The method of operating a range burner according to claim 14, further comprising adding insulation to a ring of the burner for controlling the secondary air supply to the burner.

16. The method of operating a range burner according to claim 15 wherein the insulation is configured to prevent excessive air flow to the burner from underneath the burner unit.

17. The method of operating a range burner according to claim 14 further comprising a needle valve adapted to control an air flow rate of the secondary air supply.

18. The method of operating a range burner according to claim 17 wherein the air flow rate of the secondary air supply results in a vertical shape of the burner flame.

19. A method of operating a range burner unit to control a burner flame comprising:

controlling a firing rate of a burner with knobs on the burner unit;

controlling primary burner aeration with a shutter on an inlet of the burner;

supplying a secondary air to at least one burner flame using a needle valve adapted to control an air flow rate of the secondary air supply;

concentrating a heating zone to a center of a cooking vessel to be heated by the at least one burner flame; and controlling a size and a shape of the at least one burner flame with the secondary air.

* * * * *